United States Patent [19]

Beeliën

[11] 4,066,487

[45] Jan. 3, 1978

[54] METHOD AND DEVICE FOR MAKING A NON-WOVEN PILE WEB

[76] Inventor: Cornelis W. Beeliën, 1e Const. Huygensstraat 59, Amsterdam, Netherlands

[21] Appl. No.: 685,131

[22] Filed: May 10, 1976

[51] Int. Cl.[2] ..... D04H 11/00

[52] U.S. Cl. ..... 156/72; 156/435

[58] Field of Search ..... 156/72, 435, 181, 176, 156/177, 178, 264, 254, 265, 441, 439

[56] References Cited

U.S. PATENT DOCUMENTS

| | | | |
|---|---|---|---|
| 1,970,524 | 8/1934 | Knowland et al. | 139/8 |
| 2,698,044 | 12/1974 | Runton et al. | 156/175 |
| 2,698,045 | 12/1974 | Runton et al. | 156/175 |
| 3,359,147 | 12/1967 | Miller | 156/72 |
| 3,558,411 | 1/1971 | Beeliën | 428/114 |
| 3,831,232 | 8/1974 | Bondi | 156/72 |
| 3,847,692 | 11/1974 | Bondi | 156/72 |
| 3,864,190 | 2/1975 | Coates | 156/72 |
| 3,974,020 | 8/1976 | Logan | 156/72 |

*Primary Examiner*—William A. Powell
*Assistant Examiner*—Michael W. Ball
*Attorney, Agent, or Firm*—Dressler, Goldsmith, Clement, Gordon & Shore, Ltd.

[57] ABSTRACT

A method for making a nonwoven pile web from differently colored pile yarns, lying side by side, and being arranged so as to form a color-configuration and being adhered perpendicularly in a sub-layer.

18 Claims, 36 Drawing Figures

Fig. 19a
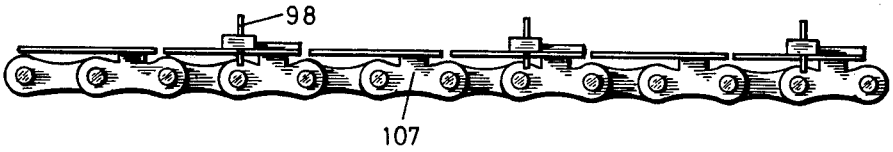
Fig. 19b
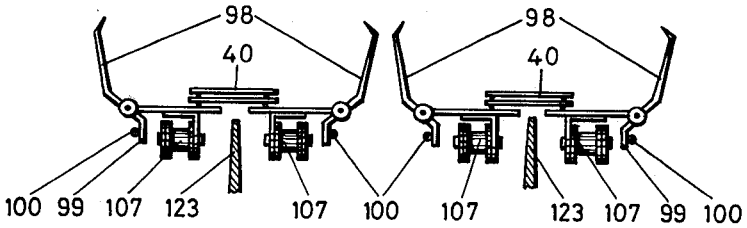
Fig. 19c
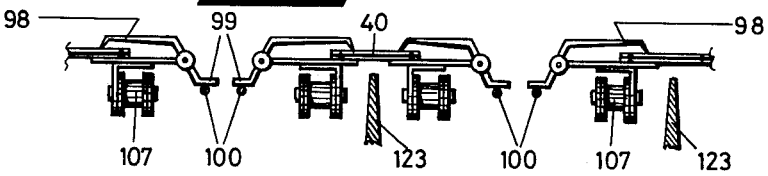
Fig. 3
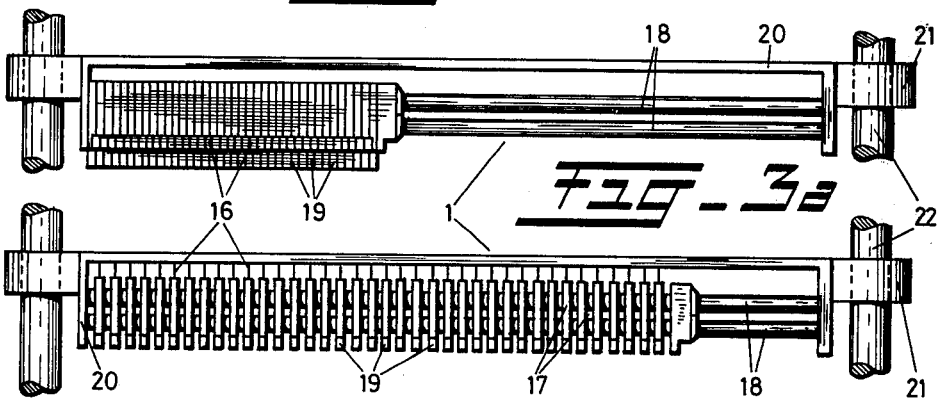
Fig. 3a Fig-4
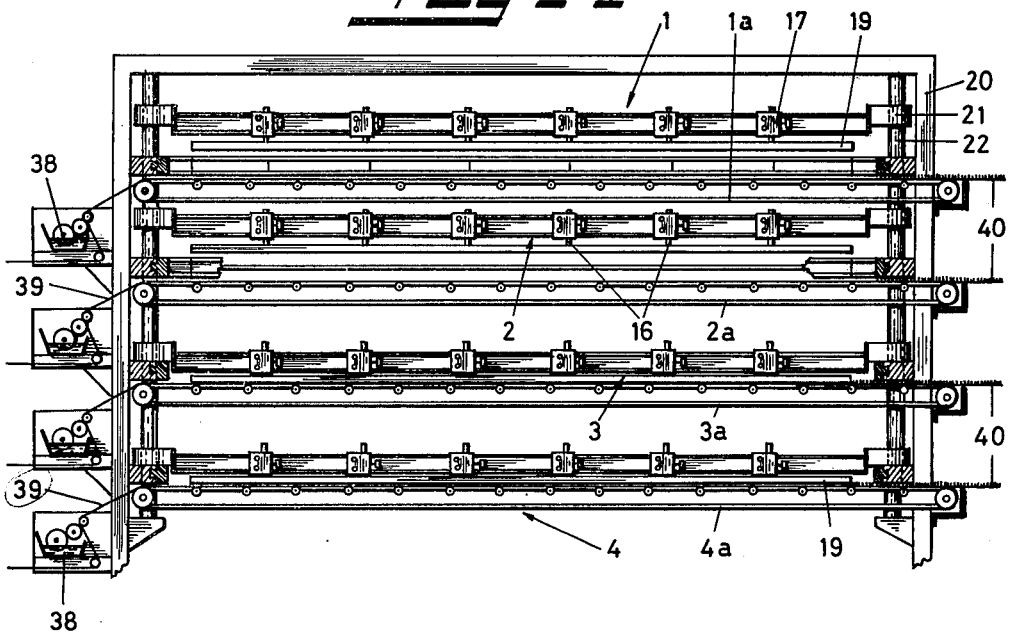
Fig-16
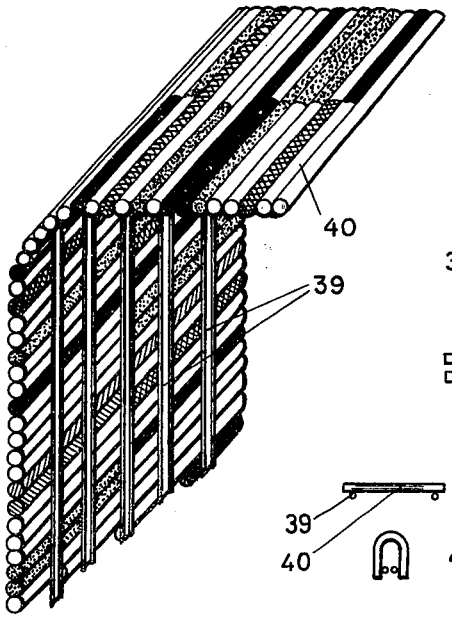
Fig-16a
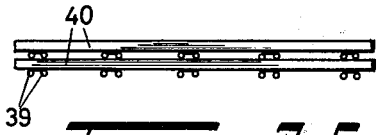
Fig-16b
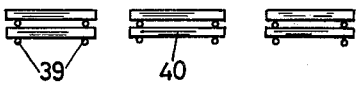
Fig-16c Fig. 6
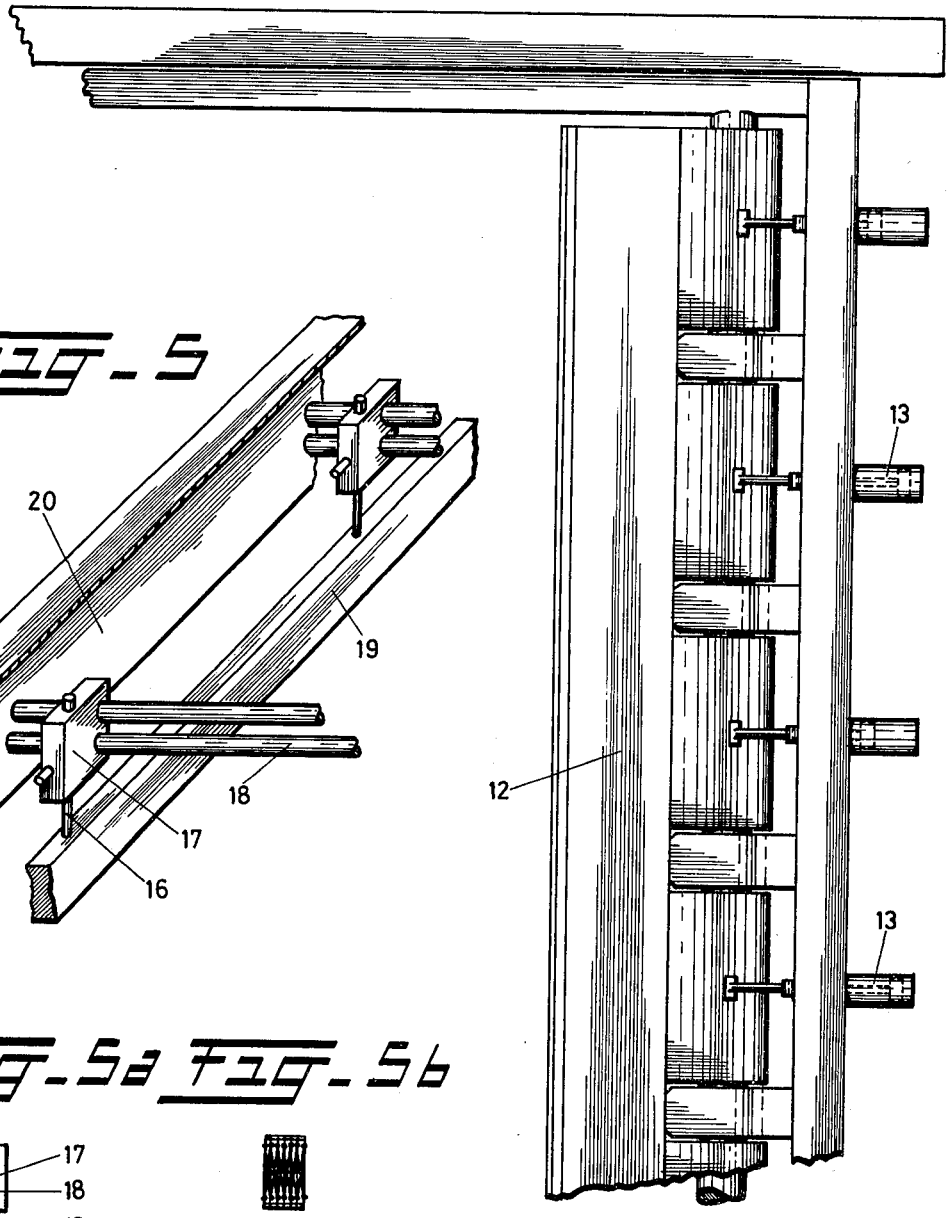
Fig. 5
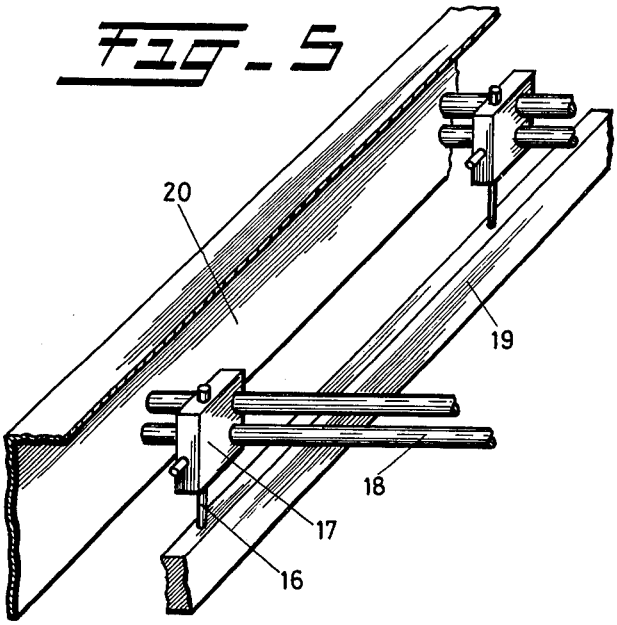
Fig. 5a
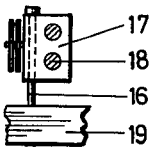
Fig. 5b
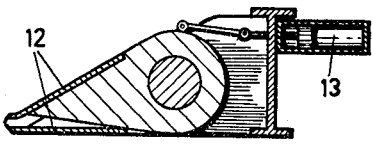
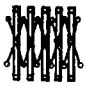
Fig. 5c

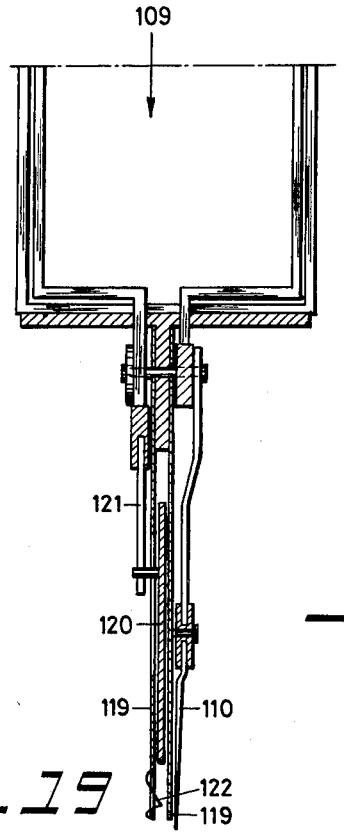
FIG. 18
FIG. 18a
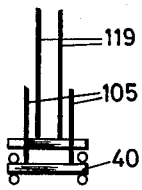
FIG. 19
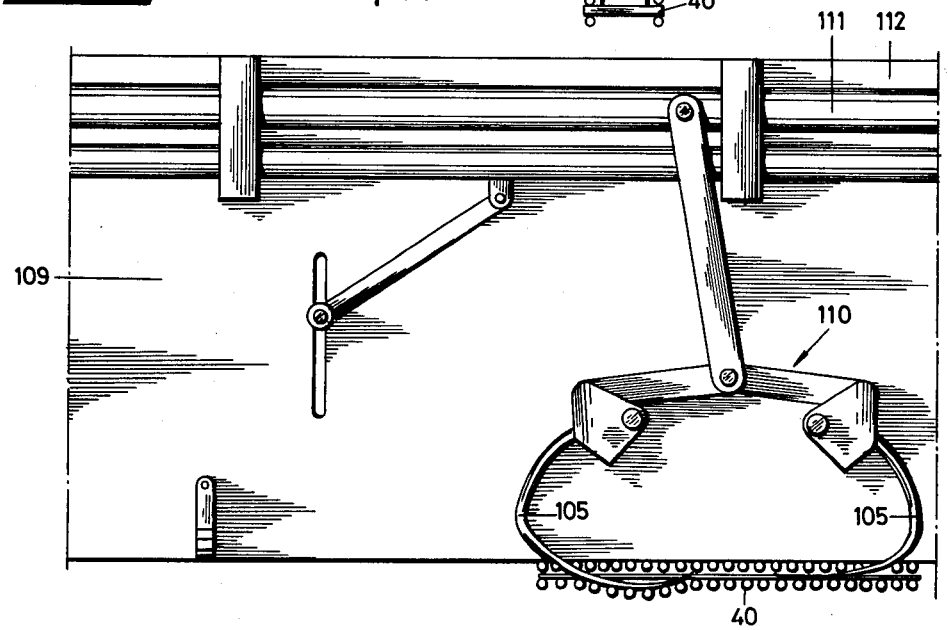

METHOD AND DEVICE FOR MAKING A NON-WOVEN PILE WEB

The present invention relates to a method for making a nonwoven pile web from differently coloured pile yarns lying side by side and being arranged to as to form a colour-figuration and being adhered perpendicularly in a sub-layer.

It is known from U.S. Pat. No. 3,558,411 (GB Pat. No. 1,147,628) to make an endless strip or web of differently coloured parts laid side-by-side in the sequence of the desired colour-figuration and by folding said strip or web in zig zag manner in the correct sequence and positioning the folded parts on top of or next to each other and joining them, a block is formed, in which the desired colour-figuration is built up by the different colour-changes of the folded layers and by subsequently cutting off layers from the thickness of said block, its thickness being equal to the width of the web or strip, webs are obtained which show the desired colour-figuration in their pile-layer.

According to another method of said Patent the endless webs which are formed from yarn end portions lying side by side and being cross-connected to each other, are cut off and a number of narrow pile strips, each one of which either being folded in zig zag manner and the folded layers being joined to a pile web or each pile strip being wound on a cylinder drum so that the windings form a tube, which is subsequently cut open and unfolded to form a web of the desired colour-figuration.

The disadvantage of the known method is that differently coloured pre-dyed yarns have to be used which are arranged by a jacquard device according to the sequence of the figurations. With a seven-colour-figuration, for a single row of yarn having a width of e.g. 5 meters, in which 2,000 piles are present side by side, 14,000 thread cones are required. With the connected spare cones, for a single row one needs 28,000 thread cones. Two rows, which are manufactured continuously in said device according to the invention, would require 56,000 yarn cones, which means a huge stock and high investment costs, and the coloured yarns are subject to become left-overs which are not used anymore in other colour-figurations.

The disadvantage of the known method, i.e. to wind each pile strip on a cylinder drum, consists in that with a view to sufficient production, a cylinder must be used for each pile strip, said cylinder having a circumference of 5 meters, which means that a large number of cylinders must be used as a consequence of which the device becomes expensive and, in addition, correct positioning of the various colour-changes of the windings in view of the build-up of the desired colour-figuration causes considerable difficulties.

The disadvantage of cutting webs from stacked pile webs to form a block consists in that it is not possible to cut said webs when they must have the length of a roll of carpet web having a width of e.g. 5 meters, and a length of 50 meters, particularly when the block, for production purposes, has a thickness of 50 carpet webs or more.

In order to prevent said difficulties the method according to the invention is characterized in that simultaneously two rows of differently coloured yarn end portions having a length equal to a multiple of the desired pile height are arranged in the sequence of the desired colour-figuration, between which in cross-direction and at a mutual spacing of 2 times the desired pile height a number of adhesive impregnated threads extending parallel to each other and disposed in series of two are pressed and joined to the yarn end portions to form a continuous,multi-coloured web, cutting the yarn ends of the multicoloured web in a direction parallel to the impregnated threads before the first impregnated thread and between the threads of each pair of impregnated threads to form a number of strips, advancing said multicoloured web and repeating the above steps to form additional sections of each individual strip to provide a length equal to the desired width of the carpet web to be made and a width equal to twice the desired pile height of the web to be made and stacking and mutually connecting said strips along the adhered, impregnated threads.

The above indicated disadvantage of the large cylindrical drums to be used for winding up the obtained product is removed when the above method is used. Moreover it is possible to make a non woven pile web with cut piles or with looped piles. The method for making webs with cut pile is characterized in that the strip sections being mutually connected along both side edges subsequently are cut in a direction parallel to said side edges in such a manner that two pile webs are obtained with single pile height. The method for making webs with looped pile is characterized in that before stacking each of the strip sections is folded into the shape of a V and subsequently the folded strip sections are stacked and are mutually connected on the side on which the impregnated threads are present.

The present invention is also related to a device for performing the above indicated method. Said device being characterized in that it comprises means for feeding a series of pile forming yarns having a length equal to a multiple of the desired pile height, means for feeding in cross direction to said yarns and at a mutual distance equal to twice the desired pile height pairs of threads extending parallel to each other and being provided with adhesive means to connect said yarns and said threads, means to cut the formed web parallel to the pairs of threads and between the threads of each pair, means to stack the obtained strips and means to mutually connect the stacked strips along the side having the threads being provided with adhesive.

For making a pile web with cut pile it is preferred that means are provided to cut the stacked strip sections being mutually connected along both sides in a direction parallel to said sides.

For making a pile web with looped pile it is preferred that means are present to fold into the shape of a V the strip sections before stacking them. A simple embodiment is obtained when the means for feeding the series of pile yarns is formed by gripping means each having a length equal to the desired width of the pile web, and it is preferred that the gripping means are present in pairs.

A simple means is provided to connect the yarns and threads. Said means is characterized in that it comprises a press means to which are fed continuous threads being provided with adhesive over a length equal to the desired width of the web and to which pile yarns are fed by the gripping means, said press means being provided at the feed-side for the yarns with a cutting means for cutting the yarns after pressing the yarns and threads together.

If the device according to this invention is used when the carpet and the figuration are not built up of more than three different colours with which the yarns are coloured continuously beforehand depending on the demand, and are controlled by a jacquard, a 5 meter width carpet web with 2,000 piles in cross direction, requires 3 × 2,000 cones = 6,000 yarn cones for each row, i.e. 12,000 yarns cones, divided over three colours, for two rows are fed simultaneously.

A further simplification of the known device is characterized in that a jacquard means is present with a number of yarn feed guides having a number of yarn feed openings for each of said gripping means to feed yarn of the desired colour to a gripper. A further simplification is that only one series of adjoining yarn supply guides is present feeding in turn yarn to the pairs of grippers. The jacquard means is characterized in that it comprises lifters and two series of slidable pins are present for each of the adjacent lifters to which each thread-feed-guide is secured, said pins being arranged one below the other in which the distance between the pins positioned one below the other of every series corresponds with and is identical to the distance between the series of two openings in the thread-feed-guides. Said jacquard device is further characterized in that each one of the two series of pins in each lifter are placed in turn in front of a single series of horizontal needles, which presses out in a predetermined sense one of the pins of a series of the desired height, whereupon all pins of the lifters lying side by side, which have been pressed out at varying heights, are positioned at equal height so that the connected yarn-feed-guides position two rows of differently coloured yarns in front of a set of grippers in the sequence of the desired colour-figurations. Said jacquard means is only necessary if yarns are used being coloured during their manufacturing. In case a plurality of differently coloured yarns has to be used it is preferred to colour said yarns in a predetermined pattern of colours before feeding them into the device described above. A yarn colouring device performing this patterned colouring is characterized in that it comprises a number of colouring devices for different types of colour, each of said colouring devices having two identical and simultaneously rotating colouring rollers, the surface of said rollers being provided with strips of foam material provided in longitudinal direction of the rollers, and that in such a way that the width of the strips of foam material is equal to the distance between the strips on the rollers in such a manner that the yarns may be coloured with sharply outlined short sections of the same length, as well as with a continuous length for which the two rollers are disposed in such a way that the space between two layers of foam material of one roller is overlapped by a strip of foam material on the other roller. Said device further being characterized in that above the rollers a number of small wheels is present to press the yarn to be coloured onto the foam material provided with colouring substance of the roller when the yarn has to be coloured.

Another type of yarn colouring device comprises a number of injectors with needle valves to which colouring material may be supplied of which injectors the housing may be moved up and down according to a predetermined sequence and said needle valves are stationary.

In using this type of yarn colouring device each pile requires only a single uncoloured yarn cone so that both rows of differently coloured threads needed for the manufacture of a carpet having a width of 5 meters, require only 4,000 cones with uncoloured yarns. The method is very economical because the stock of coloured yarns may be modest and, in addition, the length of all thread ends may be printed in more colours according to the sequence of various figurations.

A simple embodiment is obtained that is characterized in that simultaneously two rows of yarns are coloured in different colours according to the desired colour-figuration, and that the two rows are fed to a single thread feed guide having two rows of thread feed openings, said device offering in turn said two rows of yarns simultaneouly to one of the pairs of grippers of two gripping and pressing devices positioned one below the other..

With the above described device each yarn end or yarn section of a row of yarn ends lying side by side can be printed in longitudinal direction at certain distances being the same in all yarn ends of the row according to the sequence of entirely different colour-figurations with differently coloured colouring substances, so that the web constituted by joining two rows of yarn ends having been coloured in this manner, does not only have a different arrangement of the various colour changes in the length of the web, but also colour changes in the width of the web, said web being formed by the length of the yarn ends lying side by side, according to the sequence of entirely different colour-figurations.

Another advantage of the device according to the invention is that a large number of double carpet webs may be manufactured simultaneously with a colour-figuration which may extend along the entire width of the carpet, that is up to a width of 5 meters, or more and that the length of one figuration is unlimited.

A further advantage is that e.g. 40 webs consisting of 2 pile lengths connected to each other, are manufactured, the pile layer of which is subsequently cut off so that at the same time 80 pile carpet webs are manufactured or that at the same time 80 loop-carpets are manufactured.

Still another advantage of the unit is that e.g. 80 carpet webs may be manufactured simultaneously, all of them having the same figurations but that it is also possible to make eight lots of different figuration, each lot consisting of 10 carpet webs having the same colour-figurations in the pile layers.

Still another advantage is that the two webs being manufactured with mutually connected piles and after having been cut in the centre of said pile layer, show colour-figurations in the mirror-image of each other so that in laying said webs side by side a colour-figuration is formed having a width of 10 meters, which is very interesting for carpet-covering in a large room.

Still another advantage is the high production rate of carpet webs, carpets cut to size, carpet rugs or carpet squares which may be manufactured with different figuration and in pile or loop-layer at the same time, in which all steps of manufacture are carried out consecutively, i.e. without any conveyance of manufactured carpet rolls for further treatment.

The device and method according to the invention will be discussed more in detail with reference to the embodiments illustrated in the accompanying drawings, wherein:

FIG. 3 illustrates the press in rest position;

Figure 17:
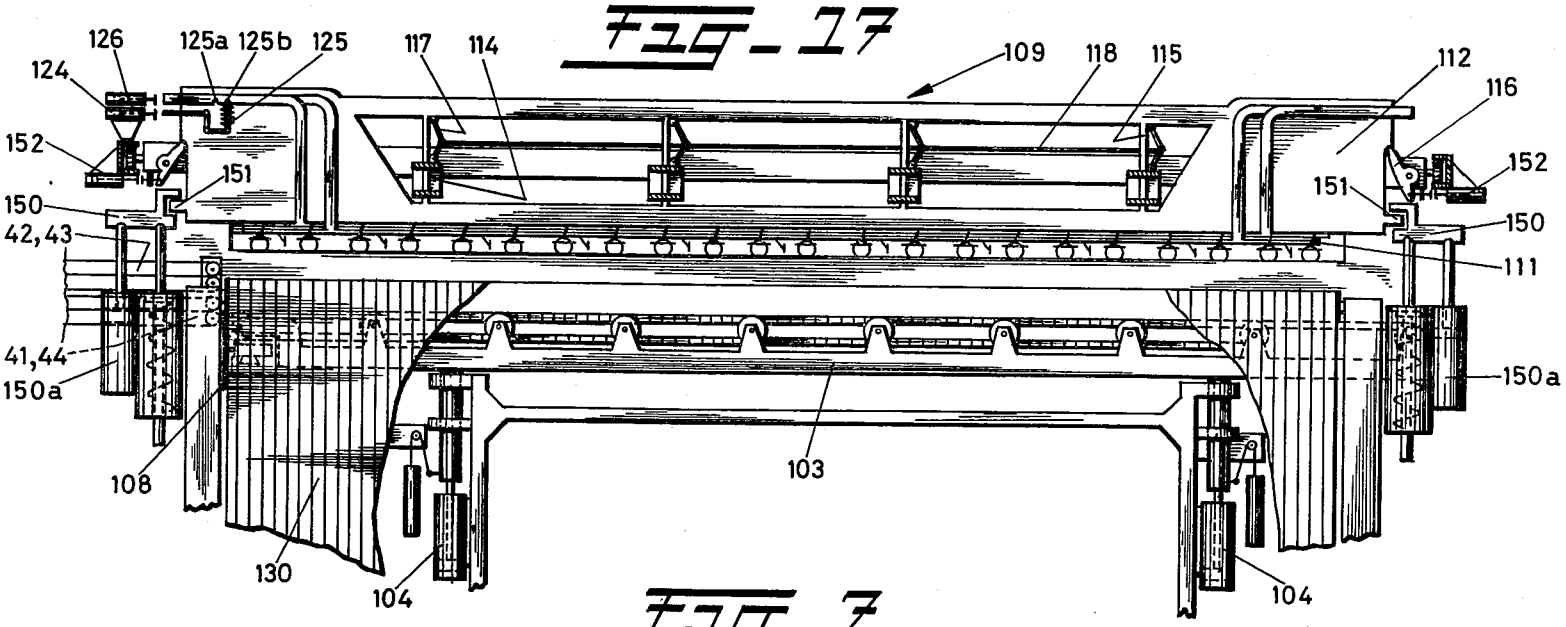
Figure 7:
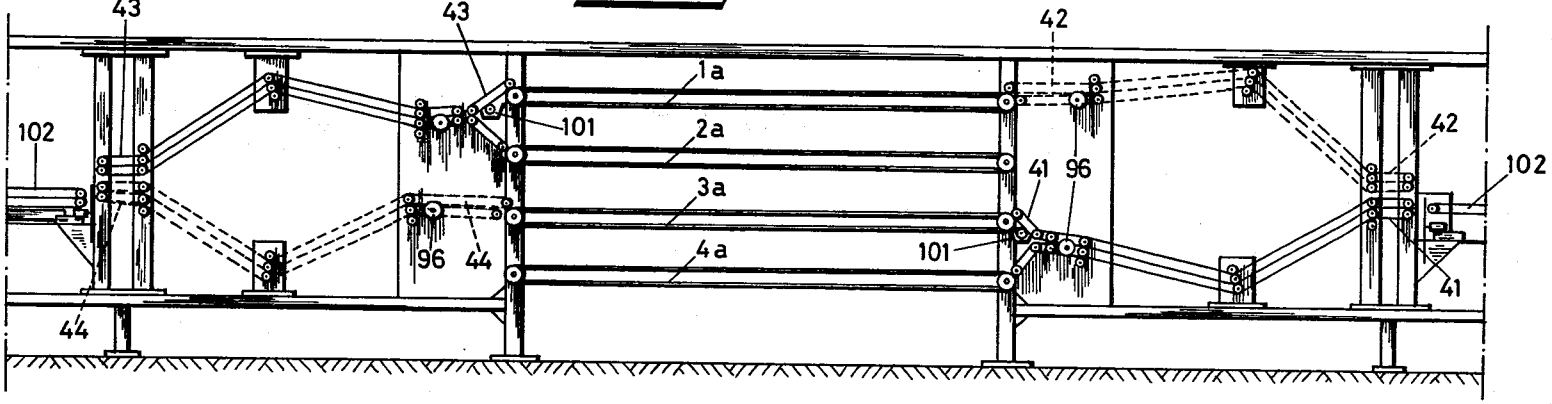
Figure 8:
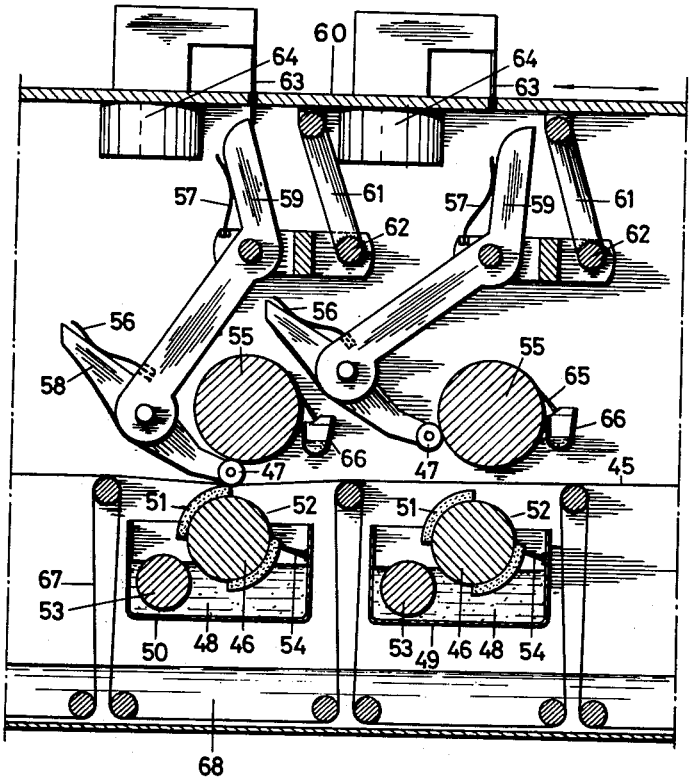
Figures 9, 9A, 10:
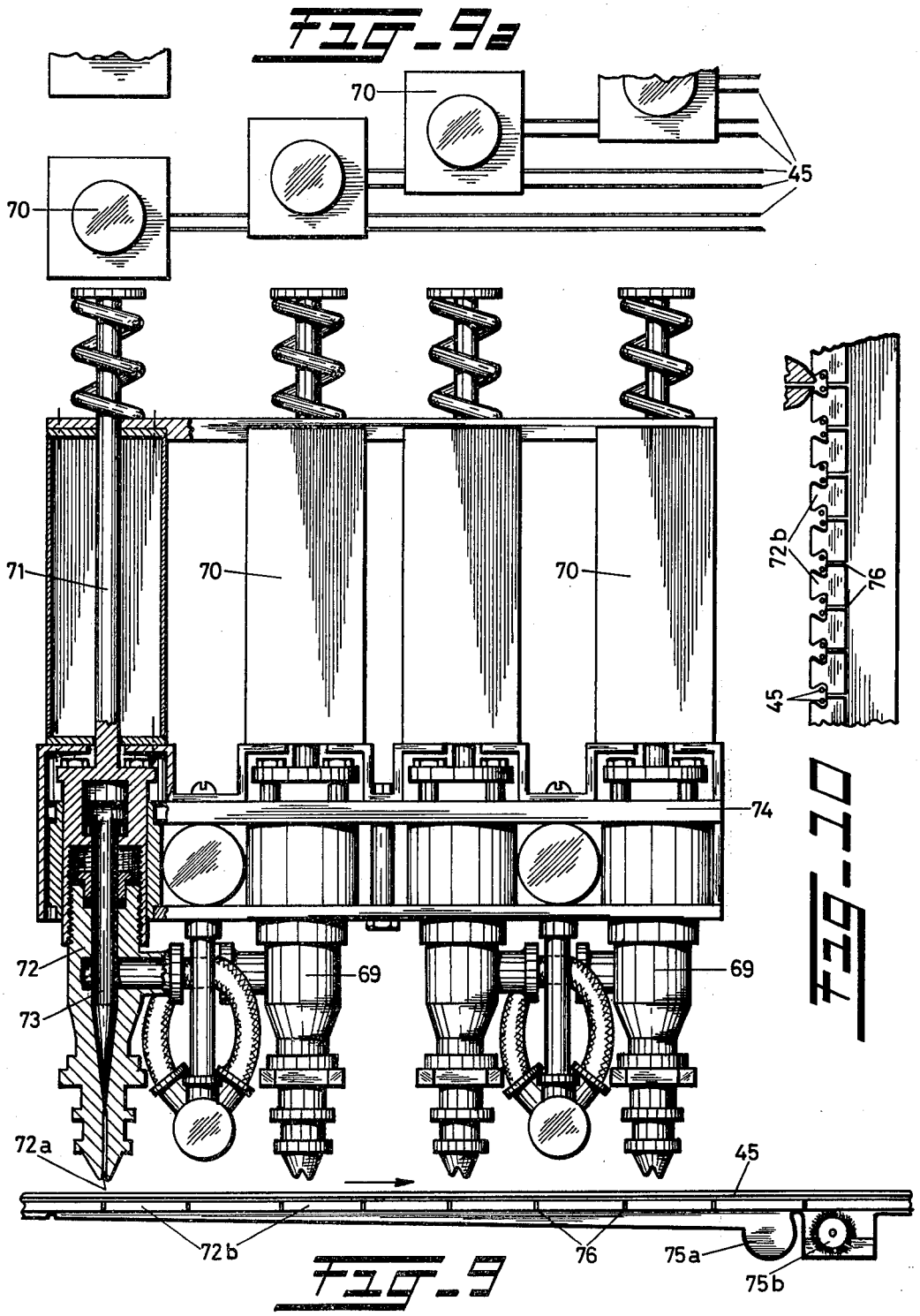
Figure 12:
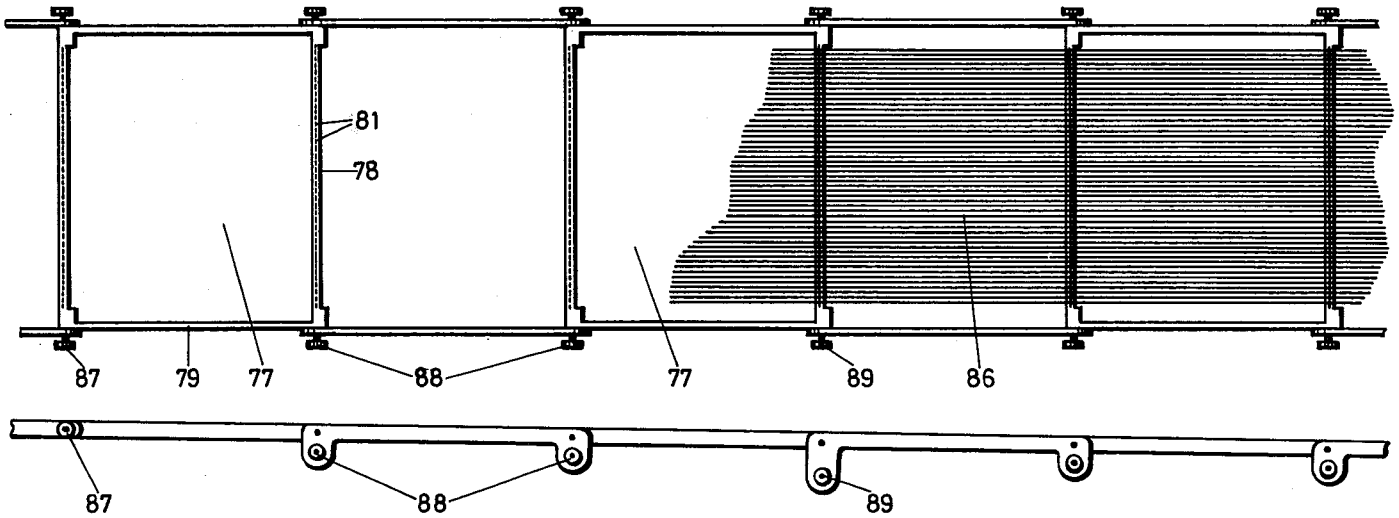
Figure 11:
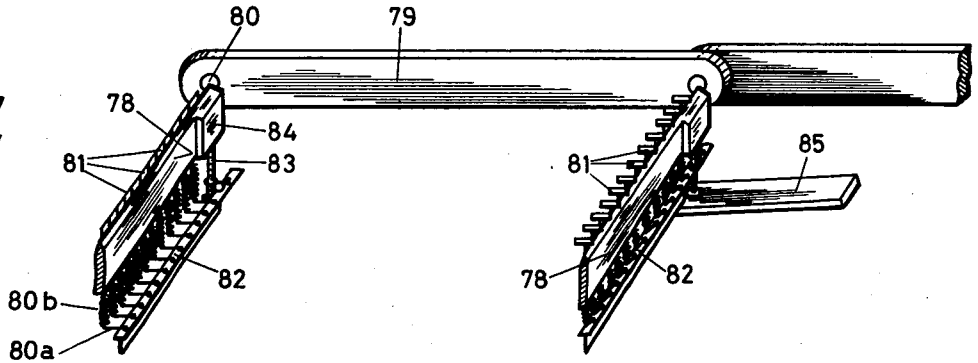
Figure 13:
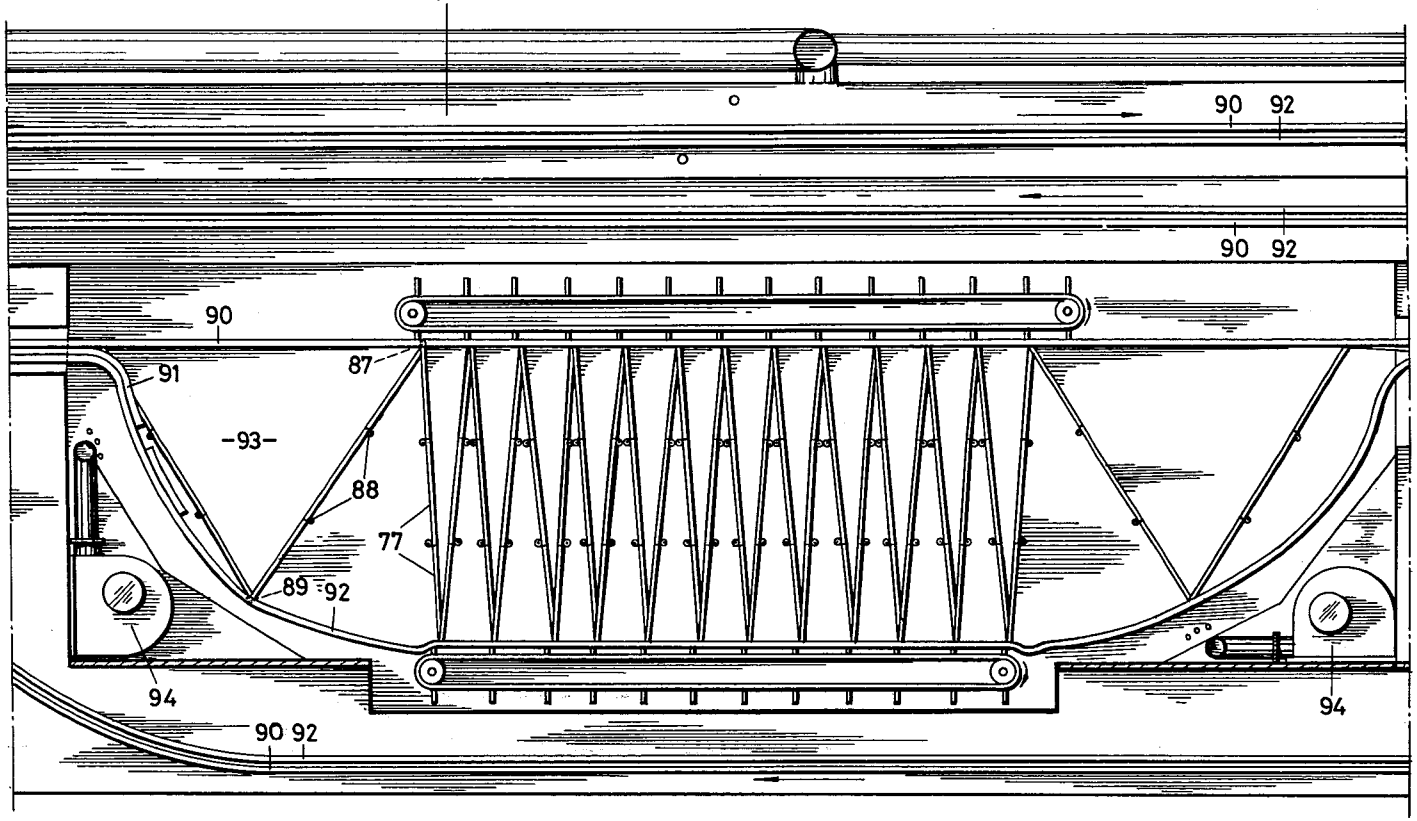
Figure 14:
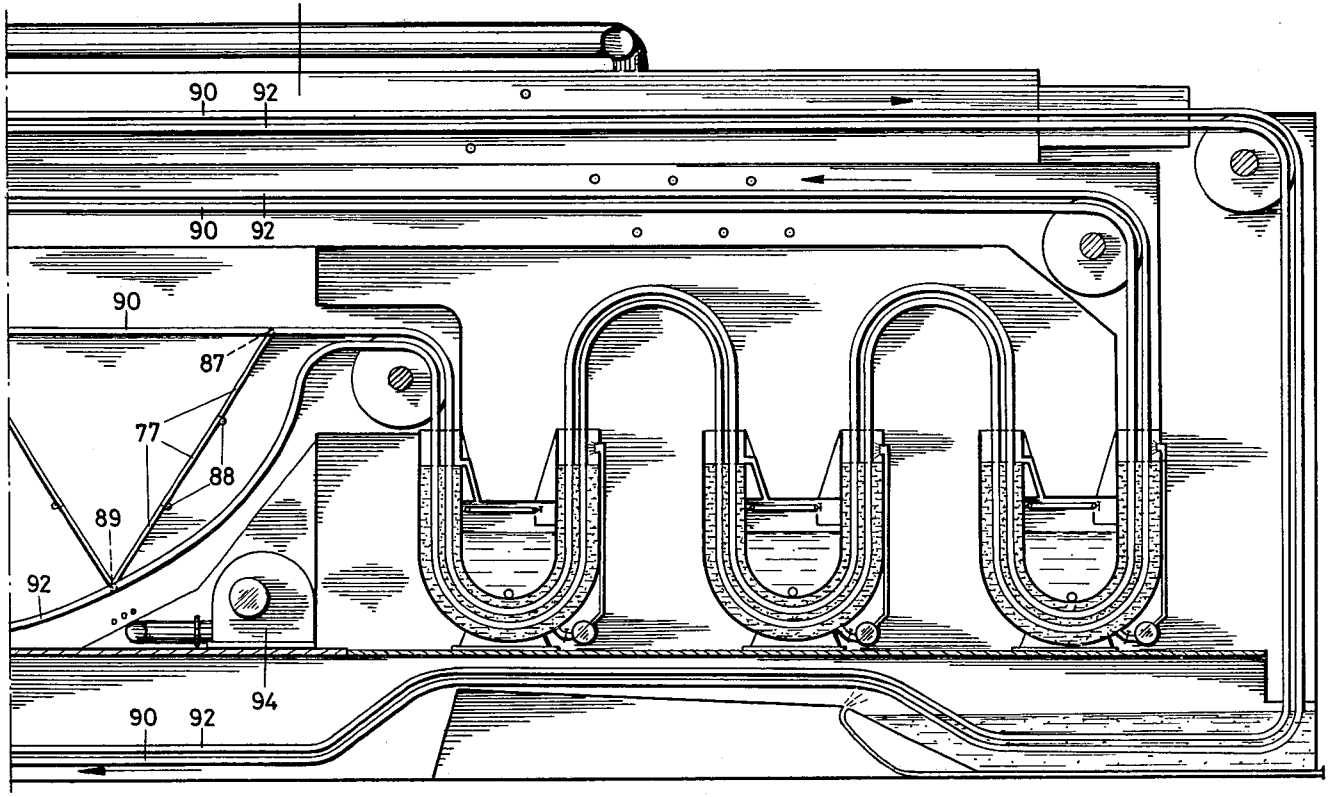
Figure 15:
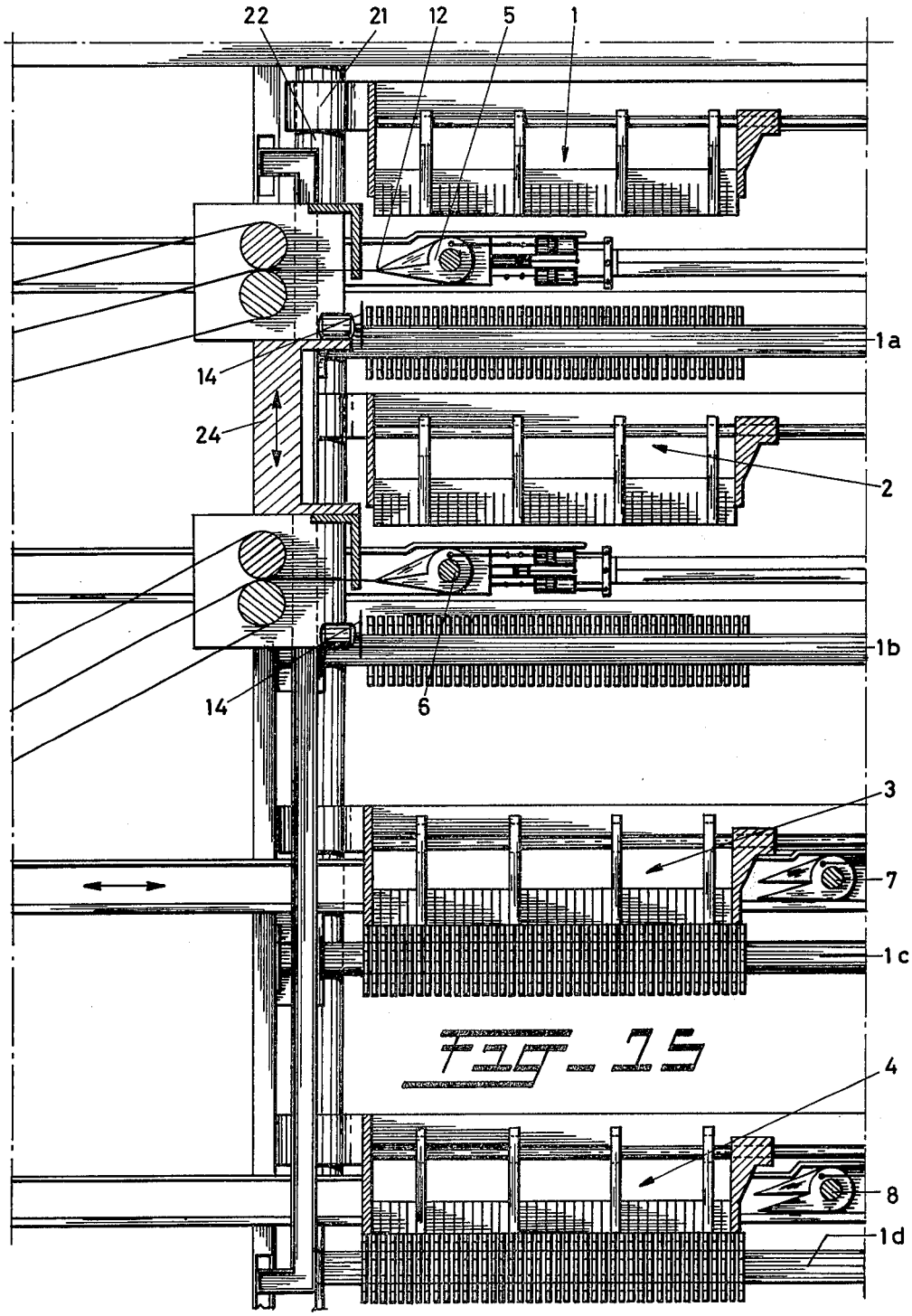
Figure 20:
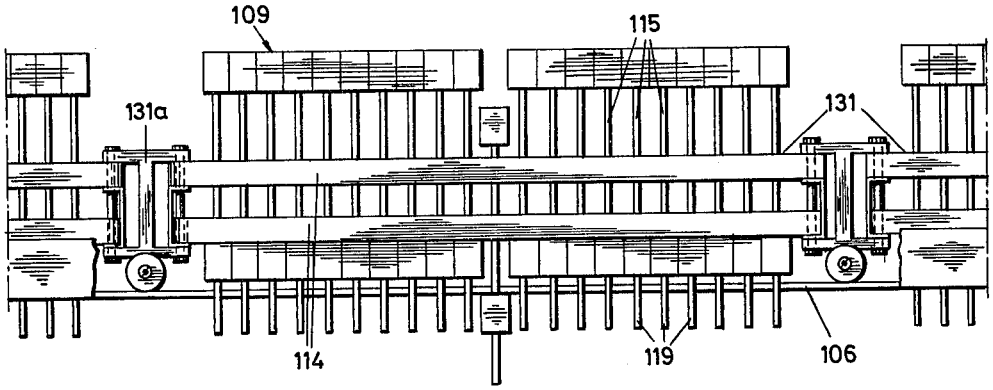
Figure 21A:
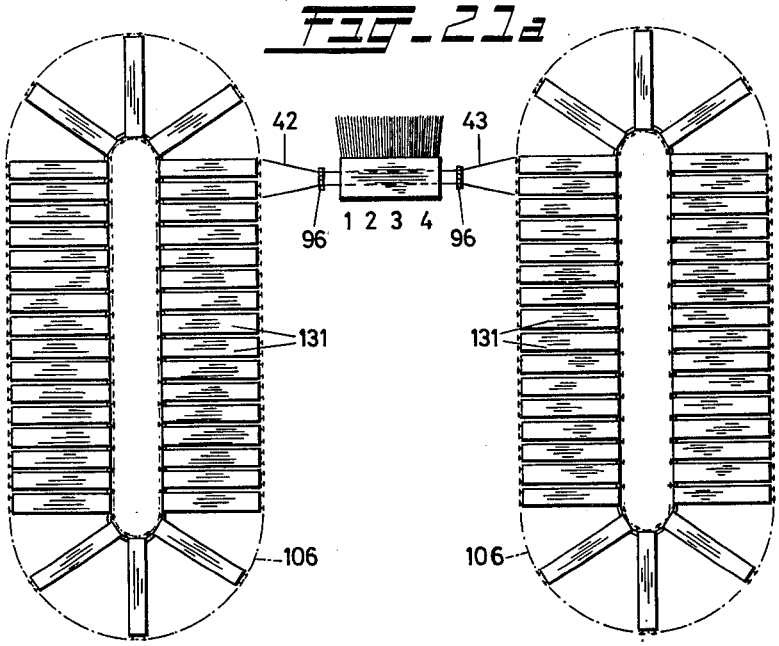
Figure 22:
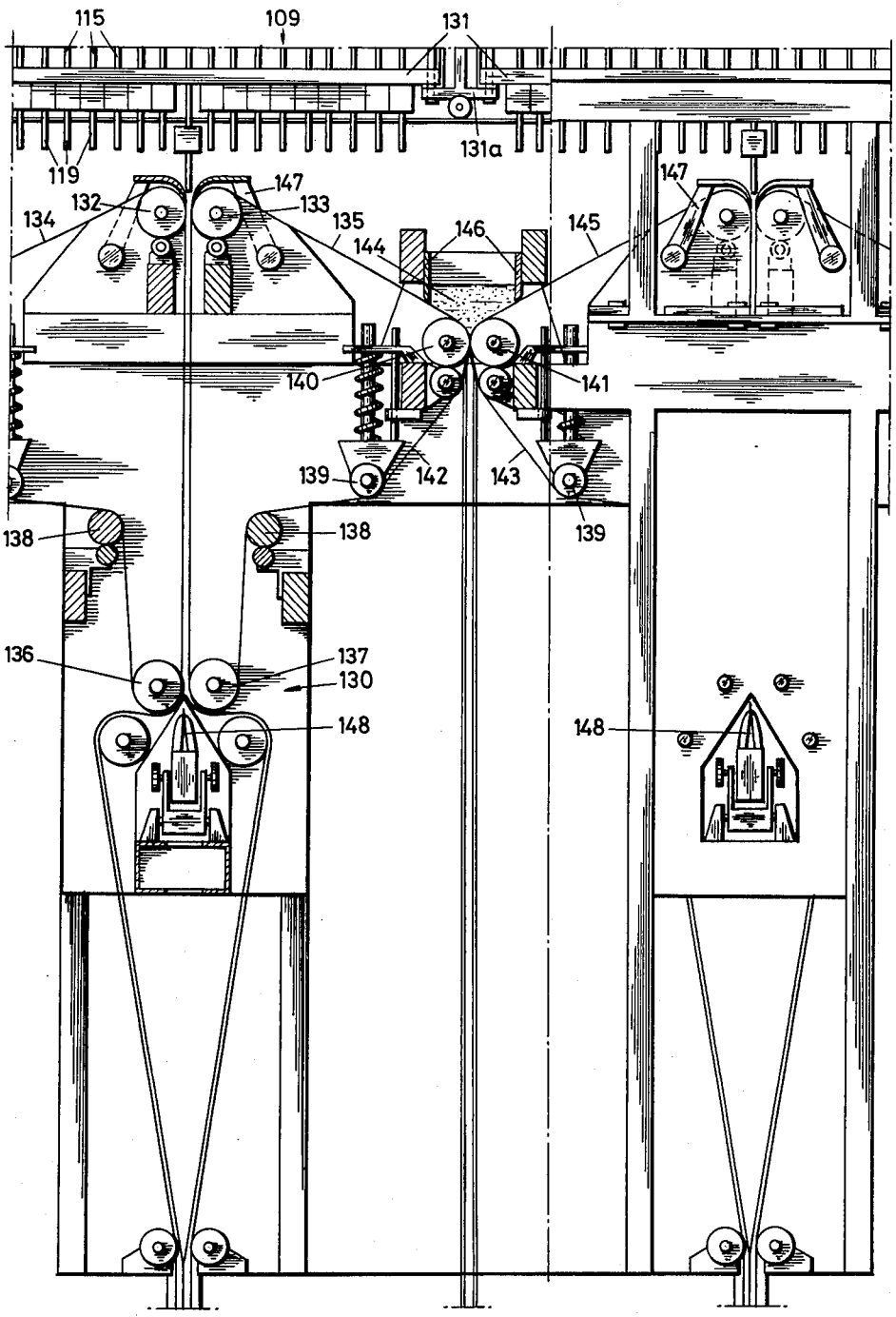

FIG. 3*a* illustrates the adjusted pressing elements in operating position for a higher pile or loop height;

FIG. 4 is a front view of the gripper and the press means and endless chains or V belts lying side by side, as well as a licker;

FIG. 5 illustrates the structure of the suspension of the elements of the press means lying side by side;

FIGS. 5*a, b* and *c* show the extension mechanism; FIG. 5*a* in side elevation and FIGS. 5*b* and *c* in not extended and extended position respectively;

FIG. 6 illustrates the structure of a gripper;

FIG. 7 illustrates the conveyance of the pile webs, the cutting device and the further transportation of the cut pile strips;

FIG. 8 is a sectional view of a colour-printing machine;

FIG. 9 is a sectional view of a colouring machine;

FIG. 9*a* is a plan view of the colouring machine;

FIG. 10 is a sectional view of an endless belt with rips between which the yarns to be coloured are kept and perforations have been provided in the belt as a result of which superfluous colouring matter is sucked out by vacuum;

FIG. 11 and 12 illustrated a conveyor belt constituted by compartments between which the yarns are clamped when being fixed, washed and carried;

FIG. 13 illustrates the position of the conveyor compartments during the process of fixing;

FIG. 14 illustrates the washing device and part of the tunnel drier; this FIGURE is a continuation of the right hand side of FIG. 13;

FIG. 15 illustrates a yarn-feed device without jacquard device being used when the yarns have been coloured in a large number of different colours;

FIG. 16 illustrates a pile web manufactured according to the method;

FIG. 16*a, b,* and *c* show different stages of the pile strips;

FIG. 17 is a front view of the vertically movable conveyor chain guides with tenter means;

FIG. 18 is a sectional view of a conveying means;

FIG. 18*a* shows the bottom side of a conveying means with a pile strip gripped by the grippers;

FIG. 19 illustrates a gripper at its proper size of a conveying means;

FIG. 19*a, b* and *c* show the operation of a gripper;

FIG. 20 illustrates a carriage with twenty conveying means and the carriage couplings;

FIG. 21 is a top view of the wheel tracks and arrangements of the stacking devices, as well as a front view and a side view;

FIG. 21*a, b* and *c* show a top view, a front view and a stacking device positioned there below respectively;

FIG. 22 is a partial sectional view of two stacking devices laying side-by-side.

In the device according to FIG. 1 and 2 two identical pairs gripping means have been arranged one below the other, two grippers 5, 6 of which, as well as 7, 8 being connected with each other and, thus operate simultaneously. Each set of grippers can be moved by the fact that the plates 28 will run with tongue and groove in plates 29, being secured to the machine frame.

A press device 1, 2, 3, 4 is present above each gripper, said device comprising pressing elements lying side by side and a number of endless V belts 1*a*, 2*a*, 3*a* and 4*a* running side by side have been provided below the grippers.

FIG. 3 is a sectional view of the pressing elements lying side by side, their length being equal to the width of the carpet webs to be manufactured, e.g. 5 meters. The distances between the pressing elements may be adjusted, depending on the desired height of the pile of the carpet webs (FIG. 3A). The V belts running side by side are also adjustable.

As illustrated in FIG. 3, 4 and, 5 and 15 each pressing element consists of pressure plates 19 laying side by side. As appears from FIG. 5, the pressure plates are connected to spindles 16 being suspended in bearing blocks 17. Said blocks 17 may be moved along spindles 18 secured to a frame 20.

Four bearings 21 are present on the press frame, said bearings may be moved along shafts 22 in vertical direction.

The blocks 17 of the pressing elements and the V belts may be adjusted by an extension mechanism as shown in FIG. 5 and 5*a*.

FIG. 6 illustrates the structure of a gripper. The jaws 12 of the grippers may be opened or closed mechanically or by means of air cylinders 13.

When with this machine colour-figurations must be made with at least three colours, then first of all uncoloured yarns are printed in three colours, which will be discussed lateron.

The device is characterized in that two rows of differently coloured pile yarns are offered alternately to one of the two sets of grippers 5, 6 and 7, 8 by the yarn-feed guides 24 lying side by side, of which the series of three rows of yarn feed openings 25, 26 lying above of each other are adjusted at variable height.

In the upper part of the jacquard device 23 the holders 24 are connected to the same number of lifters 27 which may be moved in vertical direction and which lie also side by side. The lifters are characterized in that slidable pins 30 and 31 run through each lifter, said pins having been arranged in series one below the other. The number of pins of each lifter is equal to the number of openings in the yarn-feed guides 24. One of the series of pins 30 or 31 in turn is brought at equal height in front of the horizontal needles 32 by means of the beam 33 movable in vertical direction. The jacquard card 34 in which the desired pattern is punched out brings one of the horizontal series of needles 32 via one of the series of vertical needles 35 in front of one of the projections of the horizontally moving beam 36, so that said needle is pressed outwards against one of the pins 30 or 31 respectively.

In this manner a pin of each lifter is forced out according to the data of the jacquard card. The up and down moving beam 37 shown in FIGS. 1 and 2, presses all pins forced out at different heights at an equal level, so that the lifters are positioned at varying heights and the yarn-feed guides 24 connected to the lifters are carried along also at varying heights, so that said guides offer two rows of yarns lying side by side to one of the sets of grippers 5, 6 and 7, 8 respectively.

When the colour-figurations must be composed of more than three differently coloured yarns, colouring, fixation, washing and drying techniques according to the invention are used, which depend on the composition of the pile yarns. To that end, uncoloured woollen yarns 45, which easily absorb colouring matter which, in addition, may contain substances added to prevent shrinkage of the yarns, are guided freely between rollers 46 and presser rolls 47 lying above said rollers (see FIG. 8).

For each differently coloured matter 48 two troughs 49 and 50 are disposed side by side, wherein a colouring matter of the same colour is present and all troughs are identical.

Rollers 46 rotate with the same circumferential speed in said troughs 49 as the speed of the yarns 45 advanced thereabove, said rollers at their periphery being provided with ribs 51 of foam material in the length-direction of said rollers The recesses 52 thus formed between ribs 51 have the same width as the ribs, e.g. 8 cm.

A cylinder 53 rotates in the bath 48 of colouring material and touches the foam material 51, said cylinder pressing the colouring substance into the foam layer 51, while blades 54 remove any superfluous colouring matter.

The small presser rolls 47 lying side by side are present on the periphery of a large cylinder 55 having the same dimension as the periphery of the foam material 51 of the rollers 46 and said rolls rotate with the same speed so that they are moved with the same circumferential speed.

At rest, the presser rolls are pushed free above the two yarns 45 running below said rolls by two pressure springs 56 and 57, said springs pressing against the hinged arms 58 and 59.

A plate 60 is present above arm 59, said plate being reciprocated in horizontal direction over supports 61 being hinged at points 62.

Pins have been provided side by side through the plate 60, i.e. at the same distances as the upper sides of the narrow arms 59. Pins 63 are connected to electrical magnets 64, being disposed in series one behind the other for reasons of space.

When an electrical magnet 64 receives an impulse via a patterning device, the related pin 63 is pressed downwards. When the plate 60 is moved in horizontal direction, pin 63 pushes against the upper side of arm 59 so that presser roll 47 via arm 58 and arm 59 are pressed downwards over cylinder 55 onto the two yarns 45 lying below said roll. The yarns are pressed onto the foam material 51 of rollers 46 and coloured over a distance being equal to the width of the foam rib, i.e. 8 cm, whereupon the electric contact of the magnet is interrupted and the presser roll is pressed upwards by the pressure springs 56 and 57. Blades 65 clean the cylinder 55 and the colouring matter scraped off is discharged in gutters 66.

Both foam layers 51 of the roller 46 having been disposed one behind the other in the troughs 49 and 50 overlap each other, i.e. when one roller has coloured a range of 8 cm, the next roller may print the next range of 8 cm. In this way, the yarns may be printed over a distance of 8 cm or a multiple thereof or continuously with the same colouring substance.

The yarns 45 rest on travellers 67, which are endless and which are rinsed in water 68 after each contact with the yarns.

For the colouring of yarns which are difficult in absorbing colouring matter, a yarn-colouring device in accordance with the invention is used in the present device (see FIG. 9), said yarn-colouring device comprising injectors 69 which are operated according to a program in accordance with the sequence of the desired figuration, in that the injectors have been connected to electrical magnets or air cylinders 70.

For every colouring substance the injectors 69 are staggered in four rows lying one behind the other for reasons of space (FIG. 9*a*).

The axes 71 of the magnets or air cylinders 70 are coupled to the casings 72 of the injectors 69 and the valve needles 73 are fixed to the supporting frame 74.

When a magnet or air cylinder 70 is energized the axis 71 is pulled downwards so that the casing 72 of the injector is lowered and by the fact that the valve needle 73 stays at its place, opening 72*a* is no longer barred by said needle.

The nozzle of the injector and opening 72*a* are lowered onto the underlying yarns which are kept at their place on the endless belt between ridges 72*b* (see FIG. 10). Perforations 76 have been provided in the endless belt, through which perforations the superfluous colouring substance, if any, which is discharged by the injectors, is sucked off by vacuum below the endless belt after each process of colouring.

When the various colours have been applied onto the pile yarns and the coloured yarns have been delivered, the endless belt is conveyed through a rinsing basin 75*b* and brushed clean.

In order to prevent bleeding of the differently coloured, colouring substances the yarns may be provided with a reserving agent at certain distances, having a width of 2 mm. This part always comes in the latex paste on the backing so that said part is invisible.

When the yarns have been coloured, the colouring substance may be dried and the yarns may be processed to a finished product, whereupon the colouring substances of said finished product must be fixed, washed and dried.

Another method consists in that the printed yarns are fixed, washed and dried and are then processed to a final product. Said method has the advantage that the yarns dry faster than a carpet web and that they have to be dried only once. For this reason the latter method will be discussed.

The coloured yarns 86 are clamped between compartments 77 at certain distances. A number of compartments 77 have been connected like chains (see FIG. 11, 12). The upper sides of the cross members 78 between the links 79 lie at centre height of the points of rotation 80. Rotatable pins have been provided in the partitions 78, the upper side of said pins having been provided with a thin metal plate 81. The lower side of the pins is bent to form an angle 80*a*, said pins being connected by a strip 82, said strip being connected also with a pin 83 being thicker. Said pin terminates with a cam in the bearing 84 in which a helical shaped groove is provided. The pins are pressed downwards by pressure springs 80*b*, in which the metal plates 81 with their sides abutting are pressed in the centre onto partitions 78.

When pins 83 and 80*a* are pressed upwards along guide 85, pin 83 will turn one quarter-turn so that all plates 81 will also turn open one quarter turn and in this manner the yarns may be disposed on the partitions or removed therefrom.

As illustrated in FIG. 12 the yarns 86 are in clamped position on the partitions and they are, thus, fixed, washed and dried.

Wheels 87, 88 and 89 are present on the links 79, said wheels run in three tracks 90, 91 and 92 respectively lying one below the other.

As illustrated in FIG. 13 it is, thus, possible that during the process of fixing of the yarns 86, the compartments 77 are advanced in almost vertical position in the fixation room 93 wherein exhausters 94 provide a proper distribution of steam.

When the process of fixing has been completed, the yarns are washed and dried and also clamped in the compartments 77 (see FIG. 14). When the yarns have left the tunnel drier 95 they are cooled and the plates 81 are turned open and the yarns leave the conveyor belt without any signs of shrinkage.

If shrinkage of the yarns is required they are disposed with more clearance between the compartments 77 so that they shrink during the fixing and washing.

Inasmuch as the methods applied when using simple colour-figuration, in which the yarns are coloured in plain colours and are arranged by means of a jacquard device, are equal to the methods according to which a multicolour-figuration is made, said latter method will be described in substance.

Moreover, a licker 38 is present in front of every gripper-press device, as illustrated in FIG. 4, as a result of which series of two yarns or strips 39 lying side by side may be provided with thermoplastic or latex paste.

The series of two yarns or the strips 39 lie continuously on the endless V belts 1*a*, 2*a*, 3*a* and 4*a* parallel and at a mutual distance side by side, said distance being equal to the double pile height and/or one length of a complete pile loop. The distances between the yarns or strips 39 can be adjusted.

Figure 1:
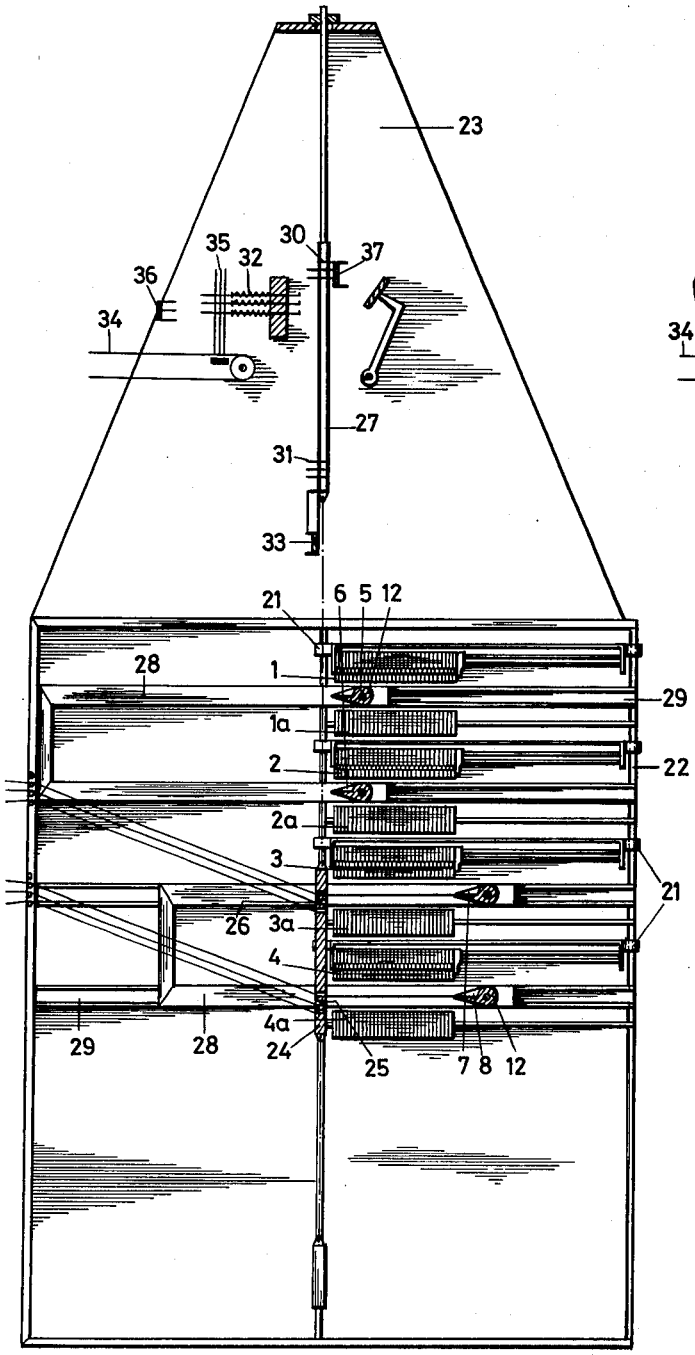
FIG. 1 and 2 are a sectional view of the gripping means with a jacquard device, said device being positioned in turn in front of one of the two pairs of grippers.
Figure 2:
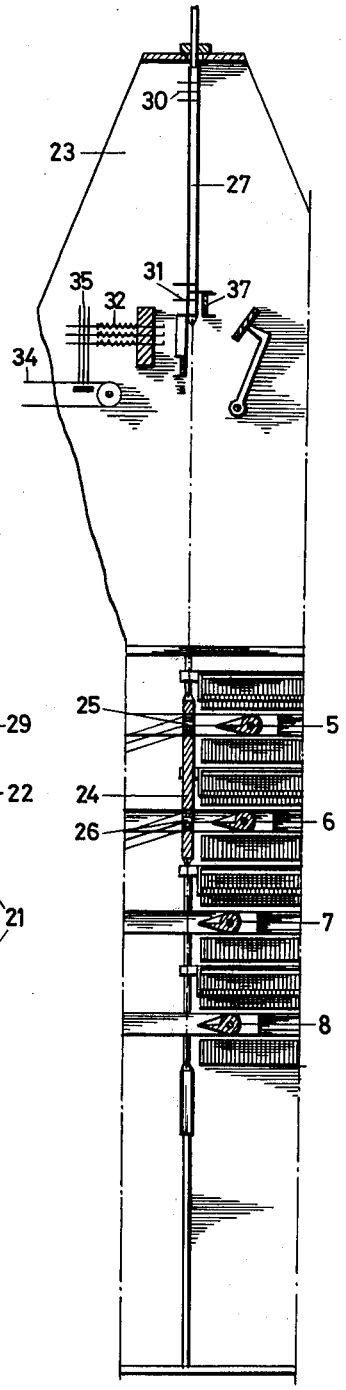

As illustrated in FIG. 1 and 15, the sets of grippers 5, 6 and 7, 8 are moved in turn towards the yarn-feed guides 24, where they pull two rows of differently coloured pile yarns threads at the length desired of e.g. 80 times the pile length of the carpet webs. The length of pile yarns being pulled is slightly longer after which the grippers are moved back slightly so that the yarns are free of tension.

The press means press the pile yarns onto the impregnated strips or threads 39 which are supplied continuously on the belts 1*a*, 2*a*, 3*a*, 4*a* so that a multicoloured web 40 is formed, whereupon the yarns are cut off along the feed device by circular knives 14.

When the yarns have been cut off along the yarn-feed device said yarn-feed devices are moved in front of the other set of grippers and, again, in the manner described above, in the other gripper-press device a new section of the pile-yarn web is added to the endless, multicoloured web 40 manufactured beforehand, said web having a length being equal to the width of the carpet webs.

During the time that one of the gripper-press devices of a set of grippers make a new section of web 40, in the other device of the other set of grippers, the endless multicoloured pile yarn web, as well as the threads or strips provided with the paste and which are not cut off, are conveyed between V belts 41, 42, 43, 44 running on top of each other and having a length being equal to the width of the carpet web (see FIG. 7).

So, every 9 seconds two pile layers having a length of 5 meters are made, said layers having an overall width of 80 pile lengths and/or loop lengths and per hour 800 pile layers are manufactured. Since in a carpet e.g. 2000 piles lie side by side in the width of a pile row of 5 meters, 800 pile rows, lying side by side, constitute a total lengths of 2 meters.

So, the hourly production is 80 carpet webs of 2 running meters having a width of 5 meters, which means in one hour 160 running meters of carpet web having a width of 5 meters, corresponding with 800 sq. meters of carpet an hour.

Irrespective of the number of colours with which the yarns are printed or coloured, which number may be 10 different colours or more, yarns are used always for two rows of yarn of only 4,000 yarn cones so that including the connected spare cones, a total number of 8,000 cones with uncoloured yarns are required.

With the yarn-colouring devices according to the invention it is possible that the yarns differ in colour every 8 cm according to the sequence of other colour-figurations, so that simultaneously ten lots of carpet strips can be manufactured with different colour-figurations, each lot consisting of eight carpet webs with identical colour-figurations.

FIG. 16 illustrates a pile web, the threads of which have been coloured in longitudinal direction according to different colour-figurations.

As illustrated in FIG. 7, the pile webs being manufactured on the endless V belts 1*a*, 2*a* and 3*a*, 4*a* respectively are joined when the latex threads or strips of one of the webs have been licked again by lickers 101, disposed between the V belts 41 and 43.

When the pile layer must be composed of loops, each pile yarn web 40 is conveyed individually between V belts 41, 42, 43 and 44.

The endless belts convey the continuous multicoloured webs 40 to a number of circular knives 96 (in the present Example fourty knives) disposed at equal distances one beside the other, the mutual distances of which being adjustable according to the length of two piles of the carpet webs to be manufactured. Said circular knives cut the webs in 40 continuous strips, i.e. exactly between every second thread or strip 39. These continuous multicoloured strips are, thus, composed of differently coloured yarn ends lying side by side and being arranged according to the sequence of the desired colour-figurations, the length of said yarn ends being equal to the length of two piles or one loop of the carpet webs to be manufactured.

FIG. 16*a* is a sectional view of two pile layers fastened onto each other, which are cut between the strips 39 (see FIG. 16*b*) and FIG. 16*c* illustrates a single pile end which is folded to a loop.

The V belts convey the pile strips 40 to a chain conveyor 102 (see FIG. 17), said conveyor being supported on a frame 103 which may be moved in vertical direction by the air cylinders 104.

Tenter means are present on the chains extending parallel side by side and the pile strips supplied are clamped on said tenter means. In FIG. 19*b* the tenter means are shown in open position and in FIG. 19*c* in closed position. FIG. 19*a* shows a front view.

The arms 99 of the tenter means 98 extend along guide means 100 whereby they can be opened or closed.

For the correct height, the chain track 102 is brought by the air cylinders 104 in front of one of the conveyor V belts 41, 42, 43 and 44 and the desired length, e.g. 5 meters, is supplied on the chains, whereupon the circular knive 108 cuts off the pile strips lying side by side.

Above the chain track 102, above the fourty pile strips 40 conveyor means 109 are present.

On each element, at the lower side, small grippers 110 are present, said grippers gripping with pins 105 in the pile strips 40 and clamp said strips. The grippers 100 are connected to each other by tension members 111 and owing to the plates 112 secured thereto the opening and closing of the grippers 110 may take place outside the press element.

FIG. 18 is a sectional view of the element 109 and FIG. 19 illustrates a gripper 110 at natural size.

Twenty elements 109 lie side by side in a carriage frame (see FIG. 20). Between the frame beams 106, constituting the length of the carriages 131, iron beams 113 have been disposed, over which and under which bearing blocks 114 have been provided. Shafts 115 extend through the bearing blocks, said shafts being secured to the conveying means 109, as a result of which the means 109 can be moved in vertical direction. Two catches 116 keep the means 109 in upward position. The hinging structures 117 are connected with each other by tension bar 118 so that the long conveying means 109 cannot bend.

As illustrated in FIG. 18, the lower side of the conveying means 109 is constituted by two sheets 119 and grippers 110 are secured at the outer side thereto.

Said grippers 110 take the pile strip if a cut pile-carpet has to be manufactured (FIG. 18*a*).

A pressure plate 120 is provided between the two sheets 119, said plate may be moved vertically by the means 121 and pressure springs 122 have been disposed at the lower side of the sheets 119.

When a carpet has to be manufactured, the pile layer of which has been composed of loops, then the pile strips are pressed in the form loops over the entire length between the sheets 119.The pressure springs 122 hold the loop strips. When the conveying means 109 has reached its destination, the loop-shaped yarn strip is forced out from between the sheets by the pressure plate 120 and the loop rows are pressed into the latex layer of a backing.

When the fourty pile strips have been disposed on the fourty chain conveyors 102, said strips being clamped on the tenter means, the frame 103 is pushed upwards by the air cylinders 104 so that the fourty pile strips 40 are pressed against the fourty elements.

When the carpet web must have an open pile layer, air cylinder 124 releases the catch 125 and air cylinder 126 moves plate 112 so that the connected tension member 111 closes all grippers 110 and the pins 105 are rotated between the yarn end portions of the pile strip 40 so that said strip is pressed against the lower side of the element 109.

When the carpet web is manufactured with loops, bars 123 press the pile strip lying between the chains between the two sheets 119 of the conveying means 109 in the form of a row of loops which is held by pressure springs 122.

The elements 109 lie in series of twenty in a number of carriages 131 running on rails (see FIG. 20), said carriages are only coupled at 131*a* to each other at the inner side of the track.

Figure 21B:
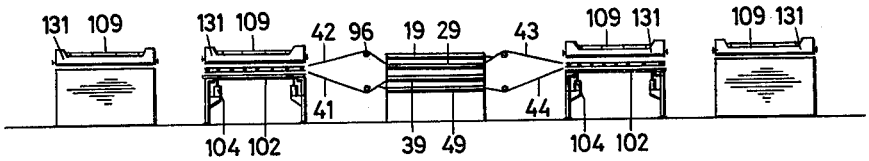
Figure 21C:
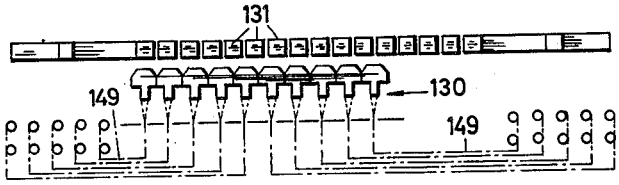

The carriages 131 are arranged in a certain number and in a certain track, as appears from FIG. 21 illustrating a top view 129 in FIG. 21*a*, a front view 129 in FIG. 21*b* and the stacking device 130 disposed thereunder in FIG. 21*c*. When the fourty conveying elements 109 have taken over the fourty pile strips 40 from the chain tracks 102, all carriages 131 are moved over a length being equal to the width of two carriages 131 and another two carriages 131 is positioned above the fourty chain tracks, the 40 conveying elements 109 of the latter carriages 131 being empty.

As appears from FIG. 21*c*, below each row of carriages 131 always 10 so in total fourty stacking devices 130 are arranged.

Each time when two carriages 131 are moved, each carriage 131 delivers a pile strip 40 to the stacking device 130 disposed thereunder and this is done always in the same sequence, i.e. the first two carriages 131 always deliver the first two pile strips 40 to the first two stacking devices 130, the second two carriages 131 always the second pile strips 40 to the second two stacking devices 130, etc.

When manufacturing loop-pile-carpets, always four loop rows are delivered by the first two carriages 131 in the aforementioned sequence.

FIG. 22 is a partly sectional view showing a stacking device 130, said device being composed of two rolls 132 and 133 being adjustable. The rolls have the same length as the width of the carpet web to be manufactured, i.e. for example 5 meters.

Endless belts 134, 135 are present on the rolls 132, 133, said belts running over rolls 136, 137, 138 and the tension rolls 139 and 140.

Roll 140 and the roll 141 of the adjacent stacking device in directions opposite to each other and the two endless belts 135 and 145 run between said rolls and two backing layers 142, 143 for the carpet webs to be made are moved between said rolls.

Above the two backing layers 142 and 143 lying on the endless belts 135 and 145 a stock of paste 144 is present so that the blades 146 apply a layer of paste onto the backing layers during their conveyance.

The backing layers provided with paste are carried along by the conveyor belts 134, 135, 145 over rollers 132 and 133.

The conveying element 109 lying above is lowered and delivers its pile strip 40 composed of two pile layers between the two backing layers 142, 143.

When the conveying element 109 has been raised, the press arms 147, which may be rotated, hit the newly arranged pile row 40, said row, with both side edges on which the adhered threads 39 are present, lying against the latex layers on the backing layers.

The press arms 147 move slightly through the latex paste of the backing layers 142, 143 before they contact the pile strip 40 and in this way they take along a small portion of the paste which is supplied to the threads 39 of the pile strip 40 during the process of pressing downwards, with the result that a portion of paste is provided on the connections of the pile strip 40, into which layer the next pile strip 40 is adhered.

In this way, adhesion of the pile strips 40 takes place at the lower side and at the side edges of the strips 40, whereby an efficient adhesion is obtained.

When a new pile strip 40 has been provided, the endless belts 134, 135, 145 are moved over the desired distance.

When the latex has dried between the backing layers 142, 143 and the pile strips 40 and, consequently, the piles are adhered to the backing 142, 143 a knife 148 cuts the piles of the web along a width of the web into two carpet webs having a width of 5 meters in which the desired colour-figurations have been provided.

Moving an element 109 (FIG. 17) in vertical direction above a stacking device 130 takes place in that air cylinders 150*a* rise slightly and the holders 150 are pressed against the projections 151. Air cylinders 152 press the catches 116 away from below the element 109 so that air cylinders 149 may be lowered with the element. The shafts 115 of the element slide through the bearings 114.

When an element 109 has been disposed between the backing layers 142, 143 in a stacking device 130, air cylinder 153 presses catch 125 out of the hole **125*b* for the closed position and 125*a* for the open position, and air cylinder 154 presses against the plate 112 so that all grippers 110 are opened. When a looped pile-carpet is manufactured, a pile strip 40 (FIG. 16*b*) is present between the two sheets 119** of every conveying means, the yarns of said pile row being bent into loops.

Rolls 132 and 133 are positioned at a distance being equal to the distance of the lower sides of two conveying elements.

The two elements 109 are lowered simultaneously until the highest point of the two rolls 132 and 133 and at the same time two strips of pile loops are placed in the latex layer of the two backing layers 142, 143 which are present on the endless belts 134 and 135.

The pressure plate 120 presses aside the loop-strip between the sheets 119 and presses the strip of pile-loops into the latex layer of the backing layers.

The backing layers 142, 143 provided in this way with pile loops are subsequently guided between said rollers. The pressing arms 147 and also the cutting means are not used here.

Since in this way 80 carpet webs are manufactured simultaneously, said webs may differ in two kinds of yarn and also in two pile heights or loop lengths or a loop and pile layers may be manufactured simultaneously in the carpet webs, while 8 lots of different colour-figurations may be made at the same time, which takes place with an hourly production of 80 × 2 meters of a carpet web having a width of 5 meters, corresponding with an hourly production of 800 sq. meters of carpet, 80 rolls of carpet webs should be moved all at the same time. For this reason, the rolling-up devices 149 (FIG. 21C) have been disposed in such a way, taking into account a lengths of 2 meters being manufactured in one hour, that always, due to adjustment of the distance of the rolling-up region, e.g. every 10 minutes only one roll of carpet having a length of 48 meters has been fully wound.

The invention is defined in the claims which follow.

I claim:

1. Method for making a nonwoven pile web from differently coloured pile yarns lying side by side and being arranged so as to form a colour-figuration and being adhered perpendicularly in a sub-layer, characterized in that simultaneously two rows of differently coloured yarn end portions having a length equal to a multiple of the desired pile height are arranged in the sequence of the desired colour-figuration, between which in cross-direction and at a mutual spacing of two times the desired pile height a number of adhesive-impregnated threads extending parallel to each other and disposed in series of two are pressed and joined to said yarn end portions to form a continous, multicoloured web, cutting the yarn ends of said multicoloured web in a direction parallel to the impregnated threads before the first impregnated thread and between the threads of each pair of impregnated threads to form a number of strips, advancing said multicoloured web and repeating the above steps to form additional sections of each individual strip to provide a length equal to the desired width of the carpet web to be made and a width equal to twice the desired pile height of the web to be made and stacking and mutually connecting said strips along the adhered, impregnated threads.

2. Method for making pile webs with cut pile according to claim 1, characterized in that the strip sections are mutually connected along both side edges and subsequently are cut in a direction parallel to said side edges in such a manner that two pile webs are obtained with single pile height.

3. Method for making pile webs with looped pile according to claim 1, characterized in that before stacking each of the strip sections is folded into the shape of a V and subsequently the folded strip sections are stacked and are mutually connected on the side on which the impregnated threads are present.

4. Device for performing the method according to characterized in that the device comprises means for feeding a series of pile forming yarns having a length equal to a multiple of the desired pile height, means for feeding in cross direction to said yarns and at a mutual distance equal to twice the desired pile height pairs of threads extending parallel to each other and being provided with adhesive means to connect said yarns and said threads, means to cut the formed web parallel to the pairs of threads and between the threads of each pair, means to stack the obtained strips and means to mutually connect the stacked strips along the side having the threads being provided with adhesive.

5. Device according to claim 4 for making a pile web with cut pile, characterized in that means are provided to cut the stacked strip sections being mutually connected along both sides in a direction parallel to said sides.

6. Device according to claim 4 for making a pile web with looped pile, characterized in that means are present to fold into the shape of a V the strip sections before stacking them.

7. Device according to claim 4, characterized in that the means for feeding the series of pile yarns is formed by gripping means each having a length equal to the desired width of the pile web.

8. Device according to claim 7, characterized in that the gripping means are present in pairs.

9. Device according to claim 4, characterized in that the means for connecting said yarns and threads comprise a press means to which are fed continuous threads being provided with adhesive and ever over a length equal to the desired width of the web and to which pile yarns are fed by the gripping means, said press means being provided at the feed-side for the yarns with a cutting means for cutting the yarns after pressing the yarns and threads together.

10. Device according to claim 4, characterized in that a jacquard means is present with a number of yarn feed guides having a number of yarn feed openings for each of said gripping means to feed yarn of the desired colour to a gripper.

11. Device according claim 10 characterized in that each one of the two series of pins in each lifter are placed in turn in front of a single series of horizontal needles, which presses out in a predetermined sense out of the pins of a series of the desired height, whereupon all pins of the lifters lying side by side, which have been pressed out at varying heights, are positioned at equal height so that the connected yarn-feed-guides position two rows of differently coloured yarns in front of a set of grippers in the sequence of the desired colour-figurations.

12. Device according to claim 8, characterized in that only one series of adjoining yarn supply guides is present feeding in turn yarn to the pairs of grippers.

13. Device according to claim 10, characterized in that the jacquard means comprises lifters and two series of slidable pins are present for each of the adjacent filters to which each thread-feed-guide is secured, said pins being arranged one below the other in which the distance between the pins positioned one below the other of every series corresponds with and is identical to the distance between the series of two openings in the thread-feed-guides.

14. Device according to claim 4, characterized in that a yarn printing device comprising a number of colouring devices for different types of colour has been provided, each of said colouring devices having two identical and simultaneously rotating colouring rollers, the surface of said rollers being provided with strips of foam material provided in longitudinal direction of the rollers, and that in such a way that the width of the strips of foam material is equal to the distance between the strips on the rollers in such a manner that the yarns may be coloured with sharply outlined short sections of the same length, as well as with a continuous length for which the two rollers are disposed in such a way that the space between two layers of foam material of one roller is overlapped by a strip of foam material on the other roller.

15. Device according to claim 14, characterized in that above the rollers a number of small wheels is present to press the yarn to be coloured onto the foam material provided with colouring substance of the roller when the yarn has to be coloured.

16. Device according to claim 4, characterized in that a yarn colouring device is present comprising a number of injectors with needle valves to which colouring material may be supplied of which injectors the housing may be moved up and down according to a predetermined sequence and said needle valves are stationary.

17. Device according to claim 4, characterized in that simultaneously two rows of yarns are coloured in different colours according to the desired colour-figuration, and that the two rows are fed to a single thread feed guide having two rows of thread feed openings, said device offering in turn said two rows of yarns simultaneously to one of the pairs of grippers of two gripping and pressing devices positioned one below the other.

18. Device according to claim 4, characterized in that each yarn end or yarn section of a row of yarn ends lying side by side may be printed in longitudinal direction at certain distances being the same in all yarn ends of the row according to the sequence of entirely different colour-figurations with differently coloured colouring substances, so that the web constituted by joining two rows of yarn ends having been coloured in this manner, does not only have a different arrangement of the various colour changes in the length of the web, but also colour changes in the width of the web, said web being formed by the length of the yarn ends lying side by side, according to the sequence of entirely different colour-figurations.

* * * * *

UNITED STATES PATENT AND TRADEMARK OFFICE

CERTIFICATE OF CORRECTION

PATENT NO. : 4,066,487

DATED : January 3, 1978

INVENTOR(S) : Cornelis Wilhelmus Beelien

It is certified that error appears in the above-identified patent and that said Letters Patent are hereby corrected as shown below:

Column 1, line 6, "arranged to" should read --arranged so--

Column 7, line 41, "are" should read --is--

Column 10, line 64, "100" should read --110--

Column 11, line 26, after "form" insert --of--

Claim 4, line 1, after "according to", insert --claim 1--

Claim 11, line 4, "sense out" should read --sense one--

Claim 13, line 4, "filters to" should read --lifters to--

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*